US007814687B2

(12) United States Patent
Cook et al.

(10) Patent No.: US 7,814,687 B2
(45) Date of Patent: Oct. 19, 2010

(54) ARTICLE OF FOOTWEAR INCLUDING A REFLECTIVE OUTSOLE

(75) Inventors: Christopher S. Cook, Portland, OR (US); Bryan N. Farris, North Plains, OR (US)

(73) Assignee: Nike, Inc., Beaverton, OR (US)

( * ) Notice: Subject to any disclaimer, the term of this patent is extended or adjusted under 35 U.S.C. 154(b) by 586 days.

(21) Appl. No.: 11/676,167

(22) Filed: Feb. 16, 2007

(65) Prior Publication Data

US 2008/0196277 A1 Aug. 21, 2008

(51) Int. Cl.
*A43B 23/00* (2006.01)

(52) U.S. Cl. ..... 36/137; 36/25 R; 36/59 R

(58) Field of Classification Search ..... 36/137, 36/25 R, 59 R, 136, 15
See application file for complete search history.

(56) References Cited

U.S. PATENT DOCUMENTS

| | | | | |
|---|---|---|---|---|
| 4,233,760 | A | 11/1980 | Haynes | |
| 5,611,156 | A | 3/1997 | Chiu | |
| 5,716,723 | A | 2/1998 | Van Cleef et al. | |
| 6,159,537 | A | 12/2000 | Crandall | |
| 6,312,782 | B1 * | 11/2001 | Goldberg et al. | 428/67 |
| 6,539,646 | B2 | 4/2003 | Brooks et al. | |
| 6,739,074 | B2 | 5/2004 | Trommer | |
| 6,754,985 | B1 | 6/2004 | Lin et al. | |
| 7,003,900 | B2 | 2/2006 | Trommer | |
| 7,165,344 | B2 * | 1/2007 | Blackwell | 36/134 |
| 7,231,730 | B1 * | 6/2007 | Ryan et al. | 36/141 |
| 2001/0004808 | A1 | 6/2001 | Hurwitz | |
| 2003/0074808 | A1 | 4/2003 | Weaver et al. | |
| 2004/0020080 | A1 | 2/2004 | Cox et al. | |
| 2004/0114353 | A1 * | 6/2004 | Romeo | 362/103 |
| 2005/0223601 | A1 * | 10/2005 | Dabah | 36/136 |
| 2005/0252043 | A1 * | 11/2005 | Blackwell | 36/134 |
| 2008/0271347 | A1 * | 11/2008 | Rosenberger | 36/136 |
| 2009/0049711 | A1 * | 2/2009 | Finch | 36/7.6 |

FOREIGN PATENT DOCUMENTS

| | | |
|---|---|---|
| EP | 0272625 | 6/1988 |
| EP | 272625 A2 * | 6/1988 |
| JP | 3280901 | 12/1991 |
| JP | 6125801 | 5/1994 |

OTHER PUBLICATIONS

International Preliminary Report on Patentability from related PCT Application No. PCT/US2008/053928 mailed Aug. 27, 2009.
International Search Report from related PCT application (International Application No. PCT/US/200853928) mailed on Aug. 1, 2008.

* cited by examiner

*Primary Examiner*—Marie Patterson
(74) *Attorney, Agent, or Firm*—Plumsea Law Group, LLC

(57) ABSTRACT

An article of footwear including a reflective outsole is disclosed. The article of footwear has an outsole including a reflective device that covers one or several portions of the outsole. The reflective device is composed of a thin and flexible material that does interfere with the natural flexibility of the outsole. The reflective device may extend over a substantial majority of a lower surface of the outsole, including a portion of the outer periphery of the outsole.

20 Claims, 5 Drawing Sheets

ARTICLE OF FOOTWEAR INCLUDING A REFLECTIVE OUTSOLE

BACKGROUND OF THE INVENTION

1. Field of the Invention

The present invention relates generally to footwear, and in particular the present invention relates to an article of footwear with a reflective outsole.

2. Description of Related Art

Attempts to add provisions for illuminating portions of an article of footwear so that it may be seen in the dark have been proposed. The first category of these disclosures makes use of phosphorescent or 'glow in the dark' technology. Van Cleef et al. (U.S. Pat. No. 5,716,723) discloses a glow in the dark shoe sole. The shoe sole includes phosphorescent polymer containing compositions. Likewise, Saruwatari et al. (JP patent number 6,125,801) discloses a light condensing resin molding that is embedded into a transparent shoe sole. The light condensing resin molding is formed by dispersing phosphors such as florescent pigments or fluorescent dyes. Akira (JP patent number 3,280,901) further discloses a shoe coated in a luminous paint. Luminous paints are paints embedded with phosphorescent compounds that may be activated by visible or ultra-violet light. A drawback of these disclosures is that phosphorescent compounds release captured light slowly, resulting in a dim glow, and a far from instantaneous response to incoming light such as a driver's headlights.

Retro-reflective materials reflect incoming light regardless of the angle of incidence. Unlike phosphorescent materials, which emit light slowly, retro-reflective materials emit light almost instantaneously, allowing for a very bright response to incident light. Previous disclosures including retro-reflective materials (often referred to simply as reflective materials) have focused on embedding strips or pieces of a reflective material into an article of footwear. Chiu (U.S. Pat. No. 5,611,156) discloses a reflective shoe having reflective surfaces between a covering layer and an underlying layer. Here, the reflecting layer is disposed along the sides of the outsole. Goldberg et al. (U.S. Pat. No. 6,312,782) discloses an article of footwear that includes discreet shaped colored polymeric objects in a transparent or translucent matrix. The polymeric objects preferably include reflective materials. Both the Goldberg and Chiu designs include the drawback of requiring both the incident and reflected light to pass through a secondary medium (which is different from air). This may reduce the intensity of the reflected light in some circumstances, reducing the ability of the reflective material to alert others to the presence on the wearer of the article of footwear.

Pearson (U.S. Pat. No. 2,607,130) discloses an article of footwear composed of rubber, having light-reflecting areas. The top of the article of footwear comprises a knitted fabric coated on the outside with vulcanized rubber, including a light-reflector mounted on the rubber coating. Lin et al. (U.S. Pat. No. 6,754,985) also discloses an article of footwear including a reflective alert strip that is fixed to the middle sole. These designs include reflectors that have been attached to the upper of an article of footwear, but do not teach a means of adhering reflective materials to the bottom of the outsole. During walking and running motions, the bottom surface of an article of footwear is often the most exposed portion, as viewed from a driver behind the walker/runner.

Along these lines, Tomlinson (U.S. Pat. No. 6,312,782) discloses an article of footwear including a shoe instep reflector. In this design, the reflector may be mounted along the bottom surface of the outsole, disposed close to the ground. A primary drawback to this design is the bulky design of the instep reflector. The reflector has a thickness that requires the instep region of the sole to be depressed in a manner that prevents the reflector from dragging against a bottom surface. Haynes (U.S. Pat. No. 4,233,760) discloses an article of footwear with a light reflective means on the upper portion and on the bottom sole portion of the article of footwear. Along the bottom of the sole potion, the light reflective means includes bars of reflective material that have been embedded in the bottom portion of the outsole. This design is also somewhat cumbersome, in that it requires the outsole to be embedded with solid strips of reflecting material. This may reduce the overall flexibility of the outsole. Furthermore, manufacturing this design requires holes to be cut out of the outsole prior to insertion of the reflective strips. In particular, both the Tomlinson and Haynes designs make it very difficult to cover the large portions of the outsole surface.

There is a need in the art for an outsole including a bottom surface with a large portion that is covered in its entirety with a reflective material. Furthermore, this reflective material should not substantially reduce the flexibility of the outsole.

SUMMARY OF THE INVENTION

The invention discloses an article of footwear with a reflective outsole. In one aspect, the invention provides an article of footwear configured to receive a wearer's foot, comprising: an outsole; the outsole including a lower surface disposed opposite the wearer's foot; at least one tread element extending away from the lower surface; the lower surface including a first portion; the first portion comprising a majority of a region of the lower surface; and where a reflective device is disposed in the first portion of the lower surface.

In another aspect, the first portion is a forefoot region of the outsole.

In another aspect, the first portion is a central region of the outsole.

In another aspect, the first portion is a heel region of the outsole.

In another aspect, the first portion is a forefoot region and a central region of the outsole.

In another aspect, the first portion is a heel region and a central region of the outsole.

In another aspect, the first portion is a combination of a forefoot region, a central region, and a heel region of the outsole.

In another aspect, the reflective device covers the entire first portion except the tread element.

In another aspect, the reflective device is flexible.

In another aspect, the reflective device includes a base layer.

In another aspect, the invention provides an article of footwear configured to receive a wearer's foot, comprising: an outsole; a reflective device attached to the outsole; the reflective device being composed of a flexible material; and where the reflective device covers a first portion of an outer surface of the outsole.

In another aspect, the reflective material includes a base layer.

In another aspect, the first portion is a forefoot portion.

In another aspect, the first portion is a heel portion.

In another aspect, the first portion is a forefoot and heel portion.

In another aspect, the invention provides an article of footwear configured to receive a wearer's foot, comprising: an outsole; a reflective device associated with the outsole; and where the reflective device is disposed along a portion of an outer periphery of the outsole.

In another aspect, outer periphery is disposed along a forefoot region of the outsole.

In another aspect, the outer periphery is disposed along a heel region of the outsole.

In another aspect, the outer periphery is disposed along a forefoot region and a heel region.

In another aspect, the reflective device is disposed along an outer periphery of the outsole.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
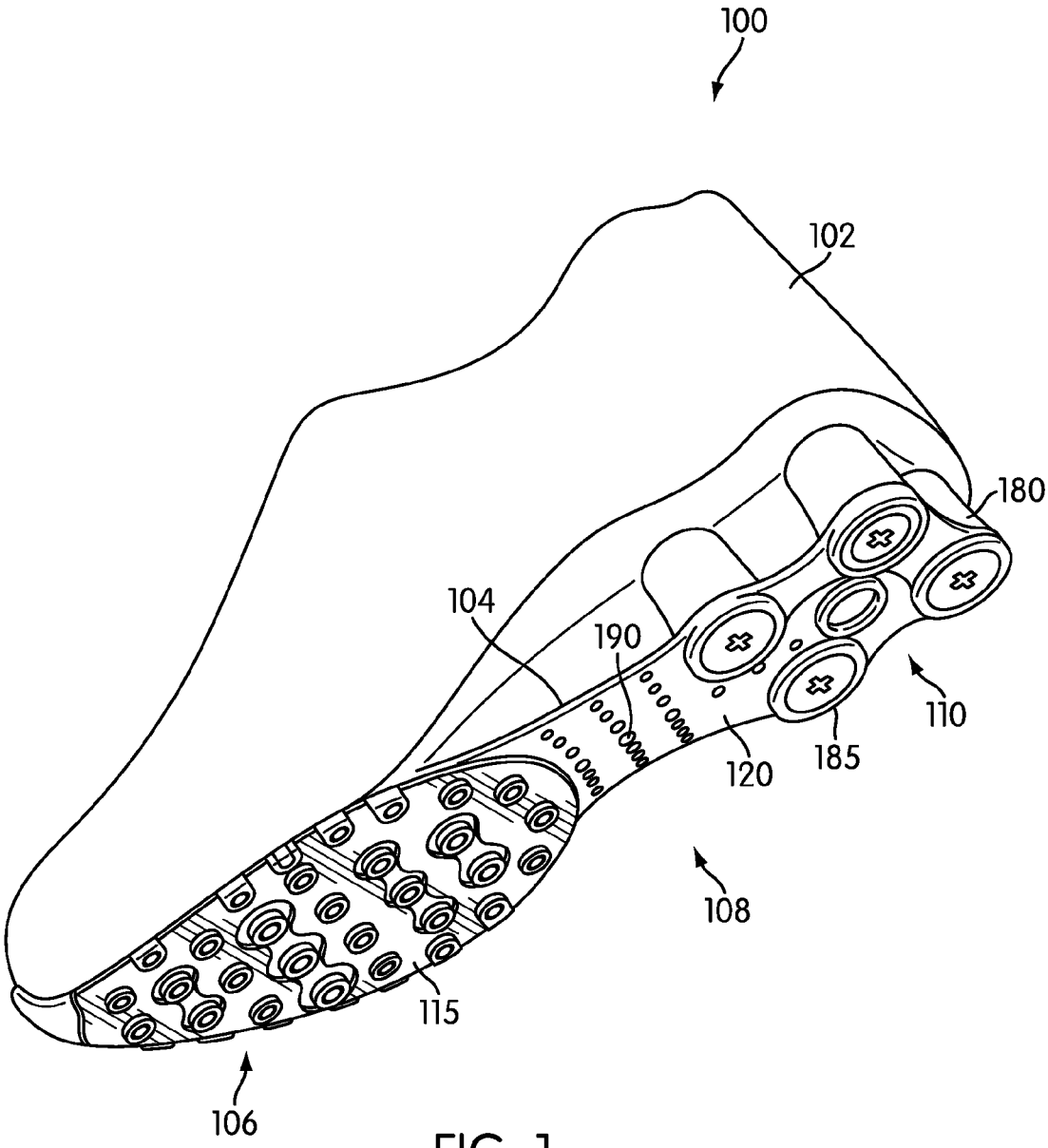
FIG. 1 is an isometric view of a preferred embodiment of an article of footwear as seen from behind.

FIG. 1 is a preferred embodiment of an article of footwear 100 in the form of an athletic shoe. For clarity, the following detailed description discusses a preferred embodiment, however, it should be kept in mind that the present invention could also take the form of any other kind of footwear including, for example, skates, boots, ski boots, snowboarding boots, cycling shoes, formal shoes, slippers, sandals, flip-flops or any other kind of footwear. That is, the properties of the reflective outsole disclosed throughout this specification and in the claims may be applied to any article of footwear.

In a preferred embodiment, article of footwear 100 includes upper 102 and outsole 104. Upper 102 is preferably configured to receive a wearer's foot. Preferably, upper 102 is associated with outsole 104, and in some embodiments, upper 102 is attached to outsole 104. Upper 102 may be attached to outsole 104 by a variety of different methods, including, but not limited to, stitching, glue, staples, as well as other methods. In some embodiments, such as sandals or flip-flops, upper 102 may be very simple and include one or more straps.

In a preferred embodiment, outsole 104 includes a first side and a second side 120. The first side of outsole 104 is preferably enclosed within upper 104. In some embodiments, the first side of outsole 104 may be configured to contact a wearer's foot. In other embodiments, the first side of outsole 104 may be configured to contact a midsole, an insole, or another type of liner. In a preferred embodiment, second side 120 of outsole 104 is configured to contact the ground. In particular, second side 120 of outsole 104 is preferably disposed along the outside of article of footwear 100 along the bottom.

Outsole 104 is preferably constructed from a lightweight and flexible material. However, outsole 104 may be constructed from any material or a combination of several materials. Some examples of material from which outsole 104 may be constructed include rubber, plastic, fabric, and metal. This list is not meant to be exhaustive as outsole 104 may also be constructed from other materials as well.

In this embodiment, article of footwear 100 includes a shock absorbing system 180 disposed proximate to a heel region 110 of outsole 104. Preferably, shock absorbing system 180 helps reduce stresses to a wearer's foot during walking and/or running. Large tread elements 185 may be disposed along heel region 110 of outsole 104, proximate to shock absorbing system 180. Outsole 104 further includes indents 190, disposed along a central region 108 of outsole 104. Shock absorbing system 180, large tread elements 185, and indents 190 are included in this embodiment as additional aesthetic and performance features and need not be included in every embodiment of an article of footwear with a reflective outsole.

The orientation of FIG. 1 is intended to demonstrate a typical position of the article of footwear during a walking or running motion. In particular, during a running or walking motion, the outsole of the article of footwear will be displayed to someone viewing the wearer from behind. This situation may occur when a motor vehicle approaches from behind. At night the driver may not be aware of the runner's presence.

For this reason, article of footwear 100 preferably includes provisions for improving the visibility of article 100 in low light conditions. In one embodiment, a reflective device is associated with article 100. In an exemplary embodiment, a reflective device is associated with the outsole of article 100. Preferably, reflective device 115 is disposed along forefoot region 106 of outsole 104. Reflective device 115 is preferably constructed of a retro-reflective material.

At night, an illumination source, including headlights of a motor vehicle, would illuminate reflective device 115 as outsole 104 is exposed during walking or running, alerting the driver to the runner's presence along the roadside. Although reflective device 115 is positioned to enhance visibility from the rear, it is also possible to view reflective device 115 from other directions. For example, if a person is running towards an oncoming motor vehicle, the driver may still see reflective device 115 illuminated along outsole 104 as the wearer's feet are raised upwards during forward strides and heel kicks.

Figure 2:
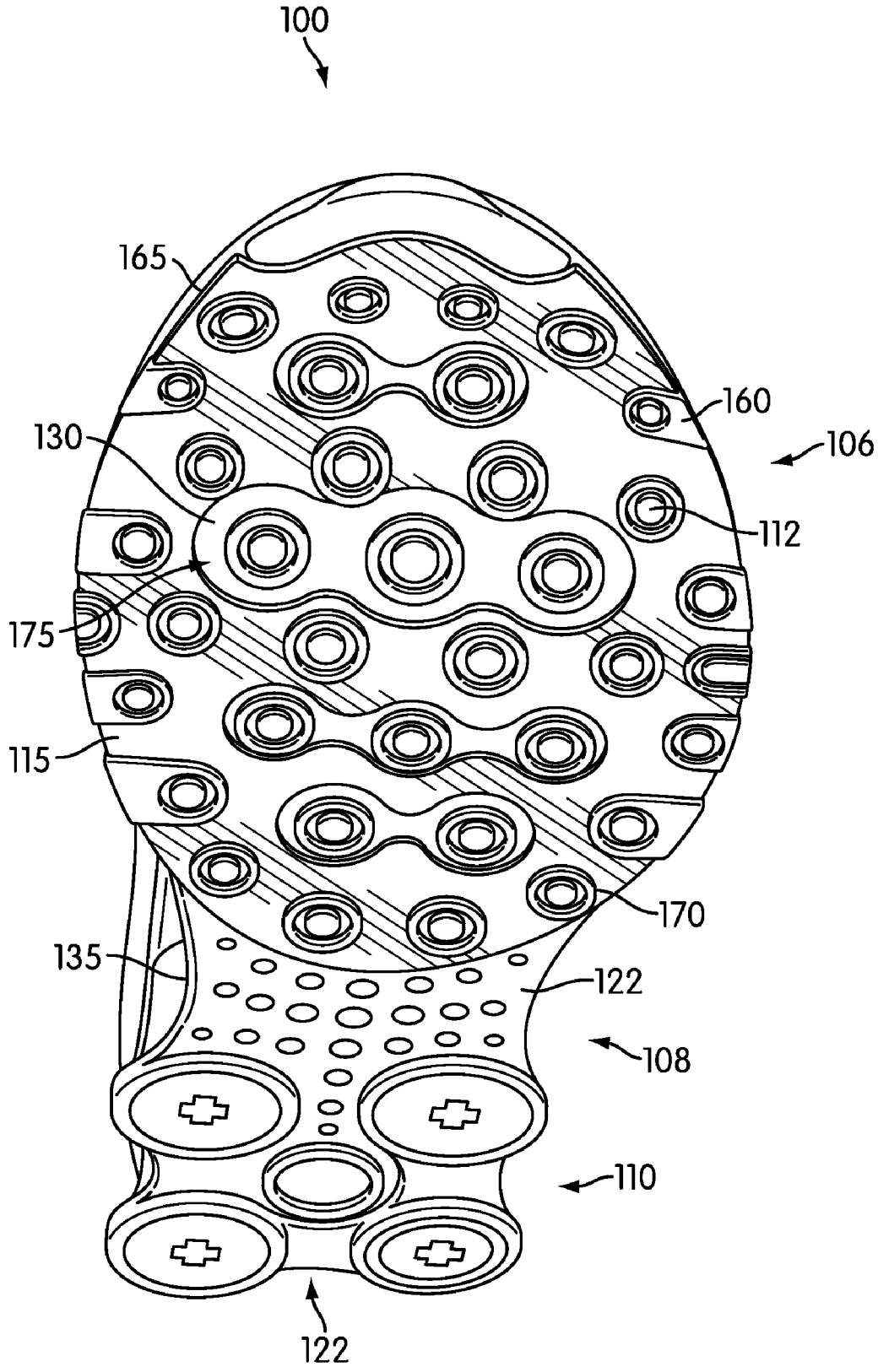
FIG. 2 is an isometric view of a preferred embodiment of an outsole of an article of footwear.

Referring to FIG. 2, a preferred embodiment of second side 120 of outsole 104 preferably includes tread elements 112. In the exemplary embodiment, tread elements 112 comprise a cylindrical shape. However, tread elements 112 may comprise any shape. Furthermore, tread elements 112 may be constructed from any material. In a preferred embodiment, tread elements 112 may be constructed of rubber. In this embodiment, tread elements 112 are disposed along forefoot region 106 of outsole 104. In other embodiments, tread elements 112 may be disposed along central region 108 and/or heel region 110. In a preferred embodiment, the spacing between tread elements may be one to two times the size of the diameter of the tread elements, though this diameter may vary among tread elements.

In a preferred embodiment, outsole 104 includes lower surface 122. Lower surface 122 generally defines a lower reference surface, and preferably, tread elements 112 extend away from lower surface 122. In some embodiments, lower surface 122 of outsole 104 includes a first portion 130. In a preferred embodiment, first portion 130 is a forefoot region. That is, first portion 130 is preferably associated with forefoot region 106 of outsole 104. In other embodiments, first portion 130 may be a central region or a heel region. In these embodiments, first portion 132 may be associated with central region 108 and/or heel region 110 of outsole 104.

In the exemplary embodiment, first portion 130 of lower surface 122 may be configured to receive reflective device 115. Reflective device 115 is preferably a thin and flexible material with retro-reflective properties. Reflective device 115 is preferably configured to cover the entirety of first portion 130 of lower surface 122 with the exception of substantially small areas surrounding tread elements 112. In the exemplary embodiment, first portion 130 comprises a majority of lower surface 122.

Tread elements 112 are preferably disposed through holes 170 in reflective device 115. As previously mentioned, tread elements 112 extend away from lower surface 122. As a result, lower surface 122 of outsole 104 may have limited contact with the ground during the use of article of footwear 100. This may result in less wear on reflective device 115.

In some embodiments, reflective device 115 may include one or more large holes 175. Large holes 175 are distinct from holes 170 because large holes 175 are large enough to accommodate multiple tread elements. Large holes 175 are included primarily for aesthetic purposes in this embodiment. Large holes 175 need not be included as part of reflective device 115 in other embodiments.

Preferably, outsole 104 may include peripheral treads 160. Peripheral tread elements 160 are distinguished from tread elements 112 in that peripheral tread elements 160 are flat on one side, rather than completely round. Peripheral tread elements are preferably disposed along a second outer periphery 165 of forefoot region 106. Because peripheral tread elements 160 are raised with respect to lower surface 122 and reflective device 115, peripheral tread elements 160 may help to prevent reflective device 115 from contacting the ground. This is particularly the case along a first outer periphery 135.

Figure 3:
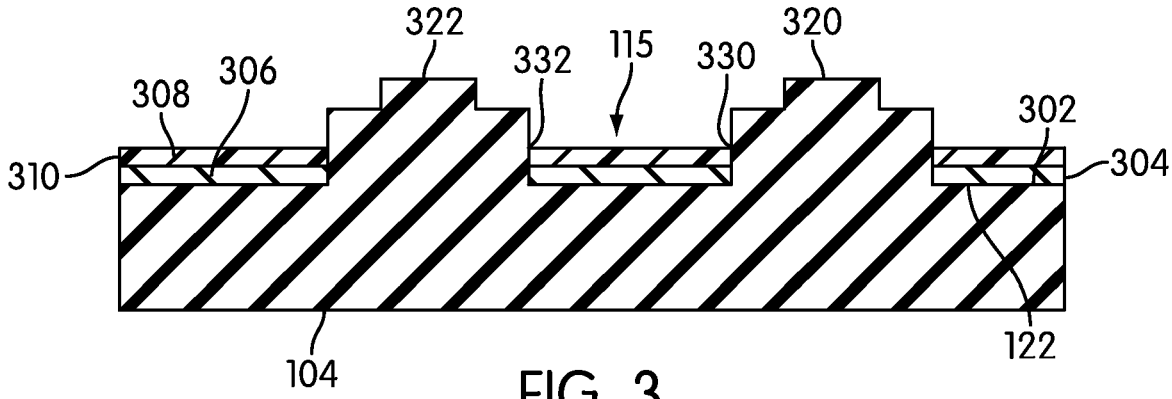
FIG. 3 is a close up of a preferred embodiment outsole of an article of footwear.

Preferred embodiments of the construction of reflective device 115 can be seen in FIG. 3. Referring to FIG. 3, a preferred embodiment of reflective device 115 preferably includes two layers. A first side 302 of a base layer 304 of reflective device 115 is preferably configured to contact lower surface 122 of outsole 104. A second side 306 of base layer 304 of reflective device 115 is preferably configured to contact a first side 308 of a reflecting layer 310 of reflective device 115. Here, a first tread element 320 and a second tread element 322 are seen to extend from lower surface 122 of outsole 104. Furthermore, first tread element 320 and second tread element 322 extend through a first hole 330 and a second hole 332 of reflective device 115.

In some embodiments, base layer 304 of reflective device 115 may be a fabric or cloth material. In some embodiments, base layer 304 may be constructed from a non-woven synthetic material. Examples of such materials include Woven, Tricot, PET film, napping cloth such as Nylex, as well as other materials. Preferably, base layer 304 is constructed from a durable and flexible material. Reflecting layer 310 is preferably composed of a reflective film. Different types of reflective film include sublimated reflective film and colored reflective film. Typically, reflective films include a glass beading structure that creates the desired reflectivity property.

Preferably, base layer 304 and reflecting layer 310 are attached to one another prior to attaching base layer 304 to outsole 104. Once reflective device 115, which is preferably comprised of base layer 304 and reflecting layer 310, is assembled, the two layers can then be attached to outsole 104. Prior to attaching reflective device 115 to outsole 104, reflective device 115 can first be cut to incorporate holes allowing for tread elements. Preferably, reflective device 115 is then added to a mold with rubber for curing. In a preferred embodiment, base layer 304 of reflective device 115 is attached to lower surface 122 during the molding process of outsole 104. The finished product is a molded rubber outsole attached to reflective device 115 along lower surface 122. This construction provides a flexible reflective device 115. This flexibility allows reflective device 115 to be applied to large areas of outsole 104 without adversely affecting flexibility or performance.

Figure 4:
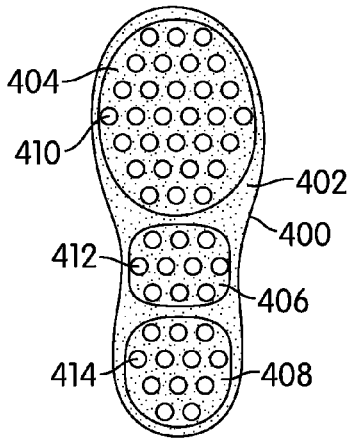
FIG. 4 is a schematic view of a preferred embodiment of an outsole of an article of footwear including three regions.

As discussed previously, a reflective device need not be associated with only a forefoot region of an outsole. In some embodiments, the reflective device may be disposed along other portions of the outsole. Referring to FIG. 4, which is a preferred embodiment of a schematic outsole 400, three distinct regions can be observed. Outsole 400 can include a forefoot region 404, a central region 406, and a heel region 408. Outsole 400 further includes three distinct groupings of treads as well as lower surface 402. In a preferred embodiment, forefoot region 404, central region 406, and heel region 408 of outsole 104 are associated with first tread element group 410, second tread element group 412, and third tread element group 414 respectively.

FIG. 4 is intended to be a schematic representation of a preferred embodiment of a generic outsole configured to be used in an article of footwear. The three regions of outsole 104 are intended as examples of possible divisions of outsole 104. Other embodiments may include a different number of regions. The size and/or shape of these regions may also vary. Likewise, the three tread element groups are intended to represent examples of possible tread element patterns. In other embodiments, tread elements may be arranged into any desired pattern and/or design. The following figures are intended to demonstrate that a reflective device may be configured to cover any region of the outsole. They are not meant to limit the use of a reflective device to only a combination of the three pre-defined regions.

The position and size of the reflective device may be varied. The reflective device is preferably disposed along a first portion of lower surface 402. In a preferred embodiment, first portion 402 may include forefoot region 404, central region 406, or heel region 408. The first portion may also include a combination of forefoot region 404, central region 406 and heel region 408. Referring to FIGS. 5-11, a preferred embodiment of outsole 400 includes a reflective device disposed along a first portion comprising forefoot region 404, central region 406, and/or heel region 408. All the possible combinations of the location of the first portion including each of the three regions are disclosed below.

Figure 5:
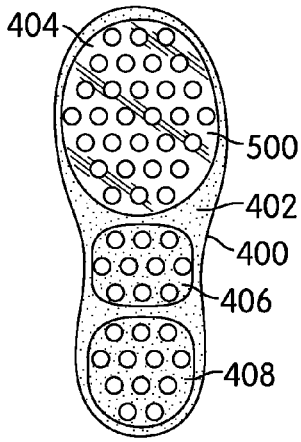
FIG. 5 is a schematic view of a preferred embodiment of an outsole of an article of footwear with a reflective device applied to one or more regions.
Figure 6:
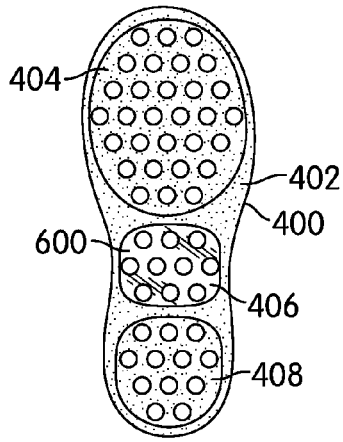
FIG. 6 is a schematic view of a preferred embodiment of an outsole of an article of footwear with a reflective device applied to one or more regions.
Figure 7:
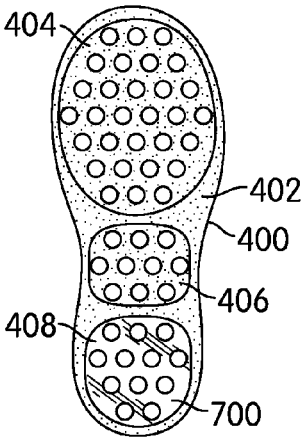
FIG. 7 is a schematic view of a preferred embodiment of an outsole of an article of footwear with a reflective device applied to one or more regions.
Figure 8:
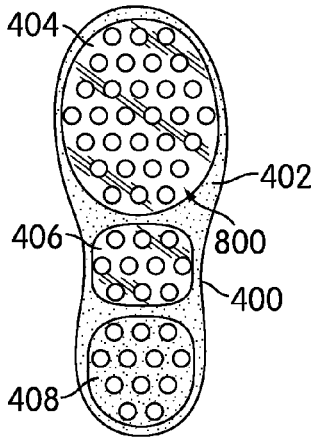
FIG. 8 is a schematic view of a preferred embodiment of an outsole of an article of footwear with a reflective device applied to one or more regions.
Figure 9:
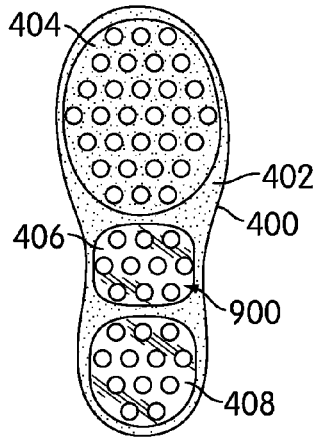
FIG. 9 is a schematic view of a preferred embodiment of an outsole of an article of footwear with a reflective device applied to one or more regions.
Figure 10:
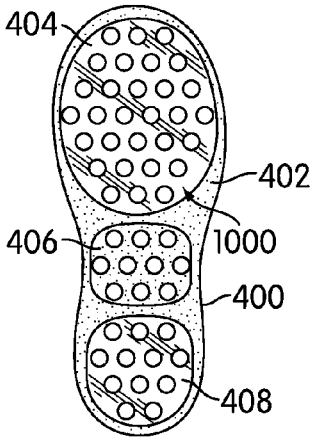
FIG. 10 is a schematic view of a preferred embodiment of an outsole of an article of footwear with a reflective device applied to one or more regions.
Figure 11:
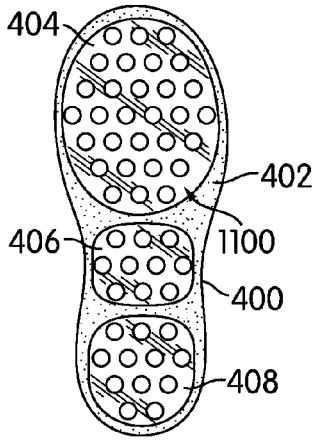
FIG. 11 is a schematic view of a preferred embodiment of an outsole of an article of footwear with a reflective device applied to one or more regions.

In each of the following figures, a reflective device is disposed along a first portion of lower surface 402 of outsole 400. The region or regions defining the first portion may be varied. Referring to FIG. 5, first portion 500 comprises forefoot region 404. Referring to FIG. 6, first portion 600 comprises central region 406. Referring to FIG. 7, first portion 700 comprises heel region 408. Referring to FIG. 8, first portion 800 comprises forefoot region 404 and central region 406. Referring to FIG. 9, first portion 900 comprises central region 406 and heel region 408. Referring to FIG. 10, first portion 1000 comprises forefoot region 404 and heel region 408. Finally, referring to FIG. 11, first portion 1100 comprises forefoot region 404, central region 406 and heel region 408. In these embodiments, a second portion may be any portion other than the first portion.

Figure 12:
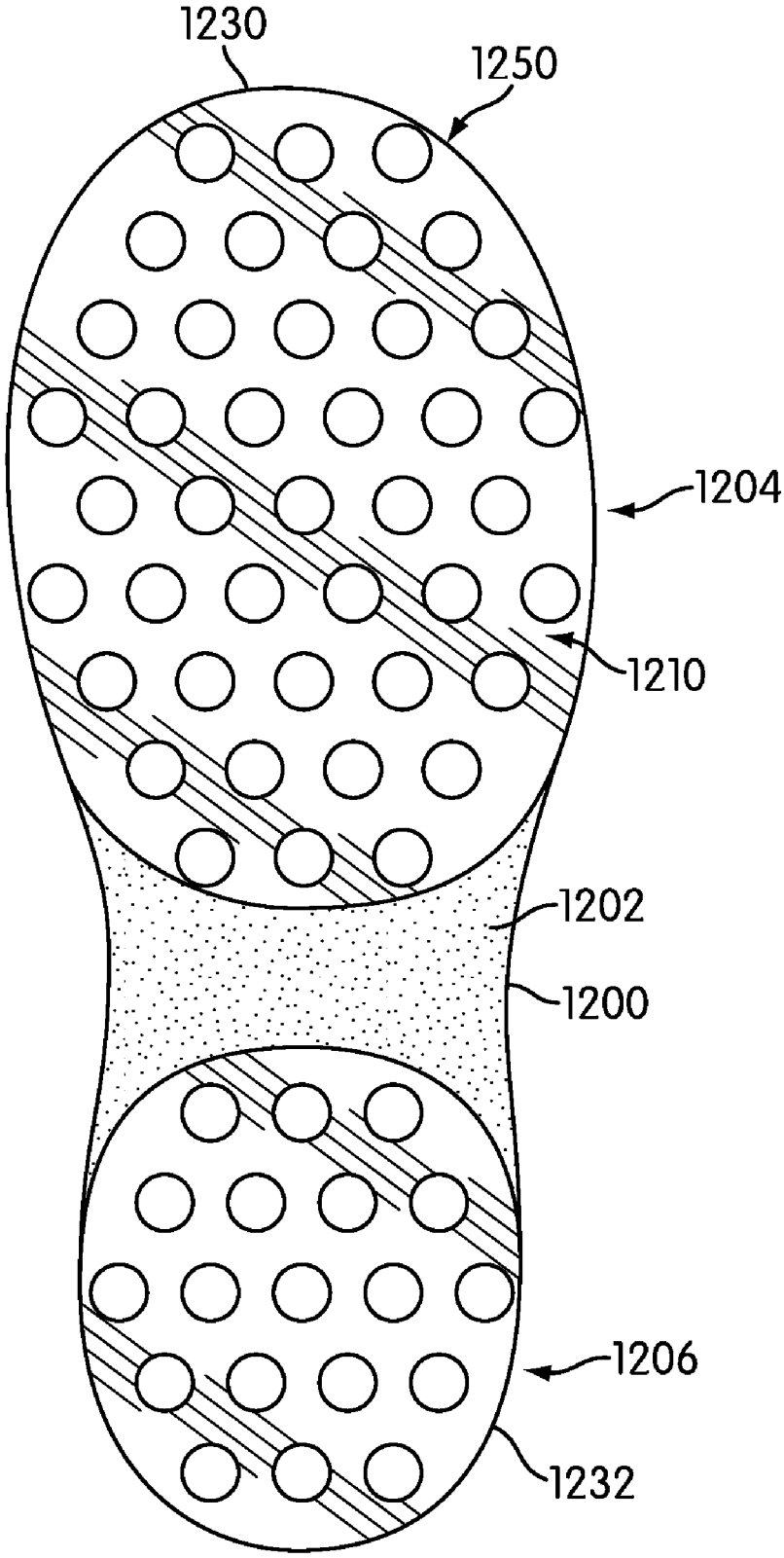
FIG. 12 is a schematic view of a preferred embodiment of an outsole of an article of footwear with a reflective device applied to one or more regions, including the periphery of these regions.

As the reflective device disclosed here is preferably constructed with a lightweight backing material, the reflective device may be extended to cover a portion of an outer periphery of an outsole. Referring to FIG. 12, outsole 1200 includes a lower surface 1202. Outsole 1200 also preferably includes a forefoot region 1204 and a heel region 1206. In a preferred embodiment, outsole 1200 further includes an outer periphery 1250 that can extend to the extreme edges of outsole 1200. In the embodiment shown in FIG. 12, forefoot region 1204 and heel region 1206 each extend to outer periphery 1250.

In this embodiment, a first portion 1210 of lower surface 1202 comprises forefoot region 1204 and heel region 1206. Preferably, first portion 1210 of lower surface 1202 includes reflective device 1220. In a preferred embodiment, first portion 1210 of lower surface 1202 is covered by reflective device 1220. In particular, reflective device 1220 is disposed along at least one portion of outer periphery. In this case, a first portion 1230 and a second portion 1232 of outer periphery disposed along forefoot region 1204 and heel region 1206 respectively. FIG. 12 is intended only as an example of the way in which a reflective device may be extended to cover a portion of an outer periphery of an outsole. Other embodiments may include a first portion having different regions and including different portions of the outer periphery of the outsole.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear configured to receive a wearer's foot, comprising:

an outsole;

the outsole including a lower surface disposed opposite the wearer's foot;

at least one tread element extending away from the lower surface;

the lower surface including a first portion;

the first portion comprising a majority of a region of the lower surface; and wherein a reflective device comprising at least one layer is attached to the first portion of the lower surface surrounding the at least one tread element.

2. The article of footwear according to claim 1, wherein the first portion is a forefoot region of the outsole.

3. The article of footwear according to claim 1, wherein the first portion is a central region of the outsole.

4. The article of footwear according to claim 1, wherein the first portion is a heel region of the outsole.

5. The article of footwear according to claim 1, wherein the first portion is a forefoot region and a central region of the outsole.

6. The article of footwear according to claim 1, wherein the first portion is a heel region and a central region of the outsole.

7. The article of footwear according to claim 1, wherein the first portion is a combination of a forefoot region, a central region, and a heel region of the outsole.

8. The article of footwear according to claim 1, wherein the reflective device covers the entire first portion except the tread element.

9. The article of footwear according to claim 1, wherein the reflective device is flexible.

10. The article of footwear according to claim 1, wherein the reflective device includes a base layer and a reflective layer.

11. An article of footwear configured to receive a wearer's foot, comprising:

an outsole;

a reflective device comprising at least one layer attached to the outsole;

the reflective device being composed of a flexible material;

wherein the reflective device covers a first portion of an outer surface of the outsole;

the outsole further comprising at least one tread element extending away from the outer surface of the outsole; and wherein the first portion including the reflective device is disposed around the at least one tread element.

12. The article of footwear according to claim 11, wherein the reflective device includes a base layer and a reflective layer.

13. The article of footwear according to claim 11, wherein the first portion is a forefoot region.

14. The article of footwear according to claim 11, wherein the first portion is a heel region.

15. The article of footwear according to claim 11, wherein the first portion is a forefoot region and a heel region.

16. An article of footwear configured to receive a wearer's foot, comprising:

an outsole;

a reflective device comprising at least one layer associated with the outsole;

wherein the reflective device is attached to a portion of an outer periphery of the outsole;

wherein the portion of the outer periphery of the outsole including the reflective device consists essentially of a lower surface that excludes a tread element extending away from the lower surface; and wherein the reflective device is disposed along the outer periphery of the outsole surrounding the tread element.

17. The article of footwear according to claim 16, wherein the outer periphery is disposed along a forefoot region of the outsole.

18. The article of footwear according to claim 16, wherein the outer periphery is disposed along a heel region of the outsole.

19. The article of footwear according to claim 16, wherein the outer periphery is disposed along a forefoot region and a heel region.

20. The article of footwear according to claim 16, wherein the reflective device includes a base layer and a reflective layer.

* * * * *